United States Patent [19]

Gillis et al.

[11] Patent Number: 4,487,266

[45] Date of Patent: Dec. 11, 1984

[54] EXPLOSION SUPPRESSION APPARATUS

[75] Inventors: Joseph P. Gillis, Westboro; William G. Andrew, Sudbury, both of Mass.

[73] Assignee: Kidde, Inc., Saddle Brook, N.J.

[21] Appl. No.: 344,531

[22] Filed: Feb. 1, 1982

[51] Int. Cl.[3] ..... A62C 35/00

[52] U.S. Cl. ..... 169/51; 169/66; 169/56; 169/28; 169/9

[58] Field of Search ..... 169/26, 28, 51, 64, 169/66, 9, 45, 56; 239/116, 117, 74, 282

[56] References Cited

U.S. PATENT DOCUMENTS

| | | | |
|---|---|---|---|
| 1,618,486 | 2/1957 | Sklovsky | 239/74 |
| 1,752,823 | 4/1930 | Walker | 239/282 X |
| 2,952,412 | 9/1960 | Munson | 239/117 |
| 4,126,184 | 11/1978 | Hinrichs | 169/56 |

*Primary Examiner*—Andres Kashnikow
*Assistant Examiner*—Mary F. McCarthy
*Attorney, Agent, or Firm*—John E. Toupal; Harold G. Jarcho

[57] ABSTRACT

An explosion suppression system disposed externally of a structure that encloses a protected zone. The system includes a source of pressurized explosion suppressant, a pressure detector, a release mechanism for releasing the suppressant through a discharge port opening into the protected zone in response to detection of a pressure wave by the detector, and tubulation providing fluid communication between the detector and the protected zone. An inclined portion of the tubulation terminates with an intake port and comprises both vertical and horizontal components of substantial magnitude.

20 Claims, 8 Drawing Figures

FIG. 1
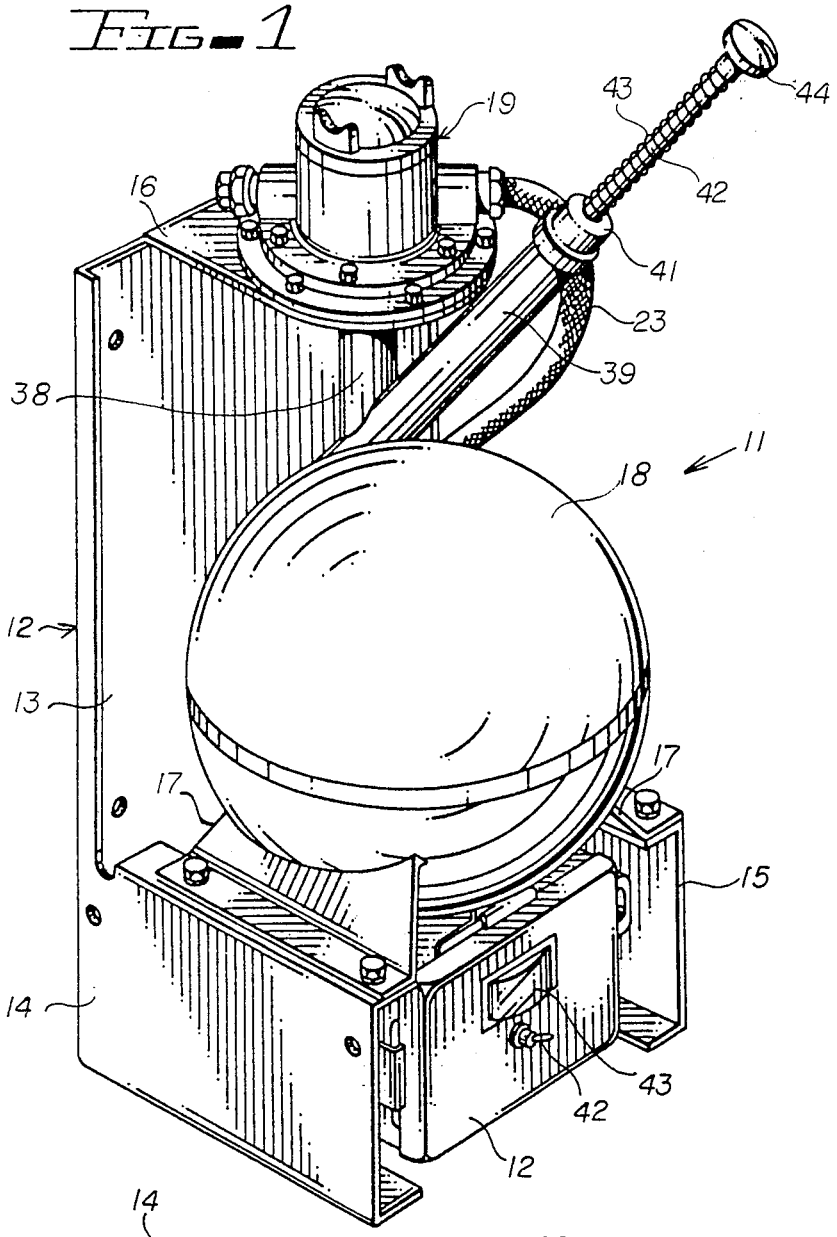
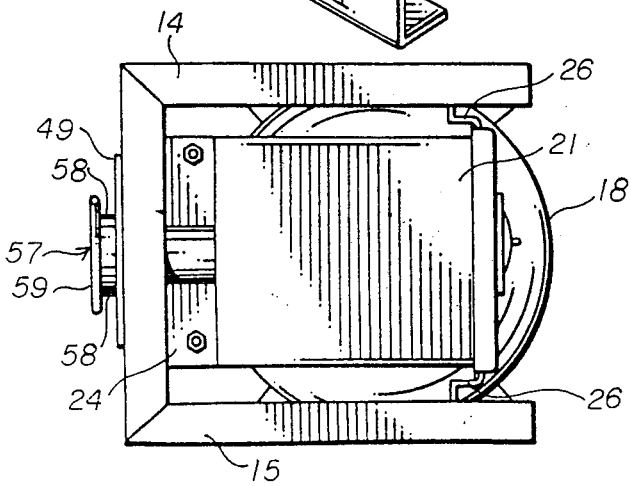
FIG. 2

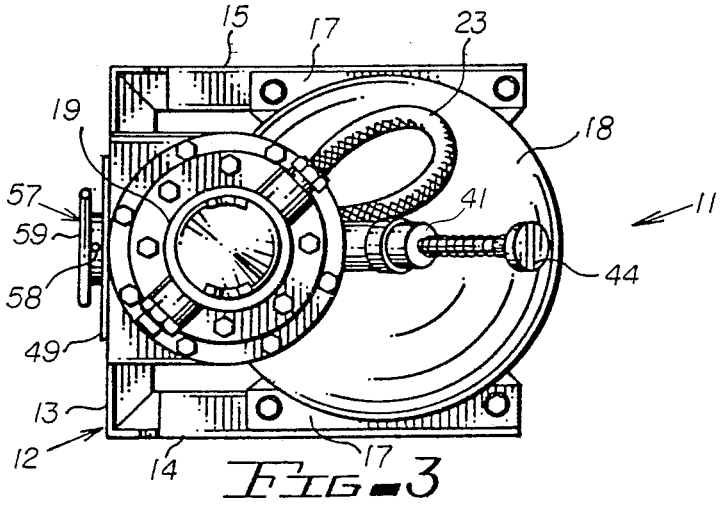
FIG-3
FIG-4
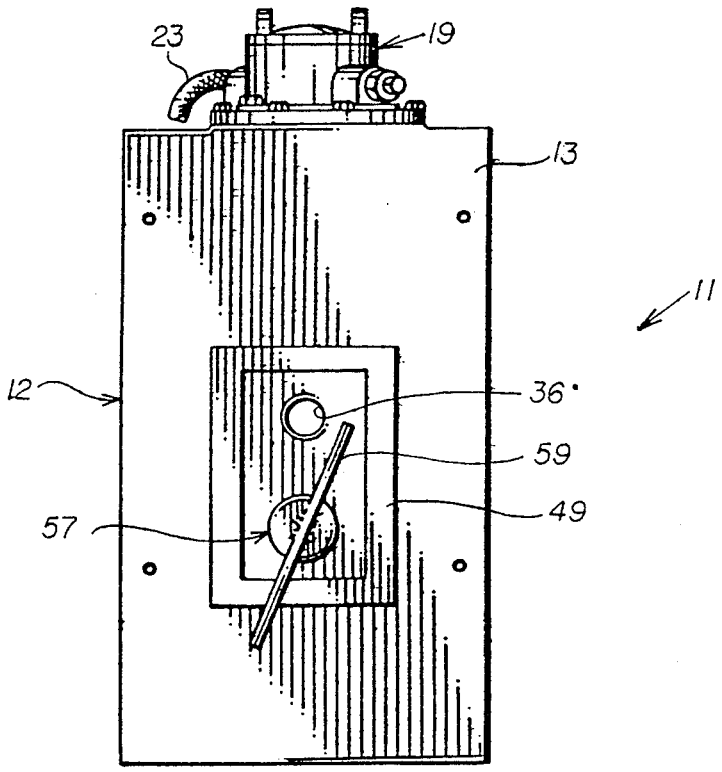

EXPLOSION SUPPRESSION APPARATUS

BACKGROUND OF THE INVENTION

This invention relates generally to explosion suppression apparatus and, more particularly, to apparatus for suppressing dust explosions.

The concern over grain industry dust explosions has grown rapidly in recent years. In addition to causing substantial property and monetary losses, such explosions have taken a heavy toll in personal injuries and fatalities. As a result, a serious need exists for improved systems to prevent or limit dust explosions.

A dust explosion consists essentially of pressure produced by the rapid burning of dust in air. The maximum pressure produced and the speed of pressure build-up (rate of pressure rise) are responsible for the damage caused by the explosion. The rate of burning of the dust cloud is affected by particle size, the ease of ignition, heat of combustion of the dust, and the concentration of dust in the air. When an explosion occurs in a grain elevator, a series of reports resembling a roll of thunder is usually heard. This is due to the fact that several explosions follow one another so rapidly that the report of one blends in with that of the next, making a continuous roar. For example, the original, or primary, explosion may occur in a cleaning machine where the dust cloud is confined in a relatively small space. The pressure and percussion from this primary explosion throws into suspension the dust which has accumulated on beams, ledges, and floors. This dust is ignited by the flame of the primary explosion, giving rise to the second explosion, which in turn, stirs up the dust in the surrounding portion of the elevator. Thus, the explosion is propagated through the elevator, or as far as dust is held in suspension or capable of being thrown in suspension.

The most effective technique for preventing dust explosion damage entails the rapid release of an explosion suppressant in response to the detection of an incipient explosion. A familiar suppressant is the halogen Halon 1301 which is typically stored under pressure and released at high velocity to create an inert atmosphere which will not support combustion. Although effective, prior suppression systems have been expensive to install and difficult to maintain and supervise in the troublesome environments that inherently accompany grain handling operations.

The object of this invention, therefore, is to provide an improved, less costly system for suppressing grain dust explosions.

SUMMARY OF THE INVENTION

The invention consists of an explosion suppression system disposed externally of a structure that encloses a protected zone. The system includes a source of pressurized explosion suppressant, a pressure detector, a release means for releasing the suppressant through a discharge port opening into the protected zone in response to detection of a pressure wave by the detector and tubulation providing fluid communication between the detector and the protected zone. An inclined portion of the tubulation terminates an inlet port and comprises both vertical and horizontal components of substantial magnitude. External mounting of the explosion suppression equipment facilitates monitoring and maintenance of the suppression equipment while the inclined tube portion reduces the possibility of dust accumulation that could obstruct the passage of an explosion induced pressure wave.

In a preferred embodiment of the invention, the system is a unitary structure supported by a frame that is mounted closely adjacent to the structure so as to provide registration between the discharge port and a fluid communication opening in the structure that defines the protected zone. An annular seal is engaged between the external wall of the structure and the frame so as to encircle both the discharge port and the communication opening and provide a fluid-tight seal thereabout. The annular seal prevents the escape of dust from the protected zone and insures that all of the explosion suppressant will be discharged into the protected zone in response to detection of an explosion.

According to another feature of the invention, the tubulation between the pressure detector and the protected zone defines both an access port disposed externally of the protected zone and a removable cover therefor. The cover can be periodically removed to facilitate removal of any debris that has accumulated in the tubulation thereby preventing a condition in which a pressure wave generated in the protected zone cannot reach the detector.

According to another feature of the invention, the system includes a clean-out mechanism for removing accumulated debris from the inclined tube portion and having an operator means disposed externally of the tubulation so as to be easily accessible by maintenance personnel. The clean-out mechanism preferably includes a plunger movable in the inclined tube portion to force debris out of an inlet port that opens into the protected zone.

According to another feature of the invention, the plunger of the clean-out mechanism comprises a coil member reciprocably mounted in the inclined tube portion. The provision of a coil plunger permits removal of accumulated debris while preventing during its use the generation of a pressure wave that might inadvertently actuate the pressure detector.

Still another feature of the invention is the provision in the inclined tube portion of a transparent section that provides visible access thereto. The transparent section allows maintenance personnel to visibly monitor debris accumulated in the tubulation.

The invention further includes a system comprising a plurality of the above-described units interconnected by pneumatic tubes. In one embodiment, the pneumatic tubes connect the pressure detectors of each unit with the discharge port of an adjacent unit. In another embodiment, the pneumatic tubes interconnect the pressure detectors of all units. This feature insures sympathetic operation of all units in response to operation of any individual unit even though the pressure inlet tubulation of detectors in certain units may be plugged.

DESCRIPTION OF THE DRAWINGS

These and other objects and features of the invention will become more apparent upon a perusal of the following description taken in conjunction with the accompanying drawings wherein:

FIG. 1 is a schematic perspective view of a suppression apparatus according to the invention;

FIG. 2 is a schematic bottom view of the apparatus shown in FIG. 1;

FIG. 3 is a schematic top view of the apparatus shown in FIG. 1;

FIG. 4 is a schematic rear view of the apparatus shown in FIG. 1;

DESCRIPTION OF THE PREFERRED EMBODIMENT

Figure 5:
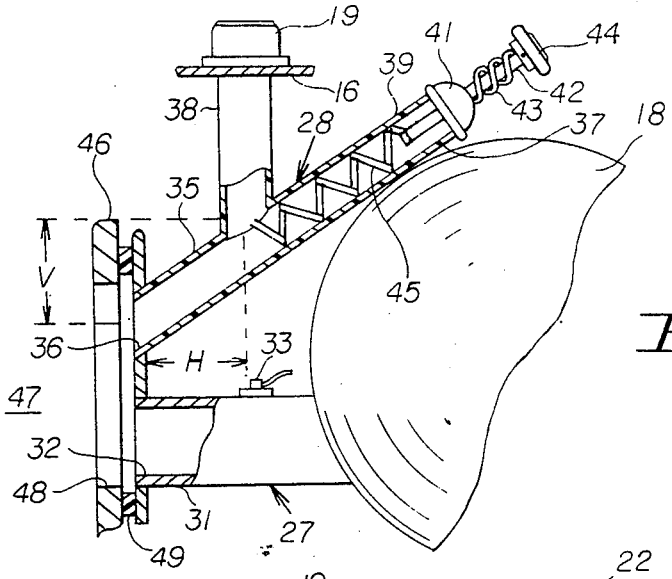
FIG. 5 is a partial schematic cross-sectional view showing a portion of the apparatus shown in FIGS. 1–4.

Illustrated in FIGS. 1–5 is a unit 11 for suppressing explosions. The unit 11 includes a frame 12 comprising a rear wall portion 13, side wall portions 14 and 15 formed by angle iron sections, and an upper support wall 16. Supported by brackets 17 from the side wall portions 14, 15 is a spherical container 18 filled with a pressurized explosion suppressant such as Halon 1301. The upper wall portion 16 supports a pressure detector 19 that consists of a conventional pressure switch with electrical contacts that close when subjected to a predetermined threshold pressure. Mounted between the side wall portions 14, 15 is a housing 21 that retains an electrical circuit 22 shown schematically in FIG. 6. The control circuit 22 is connected to the pressure switch 19 by an electrical cable 23. As shown in FIG. 2, the housing 21 is held by a support 24 extending from the rear wall portion 13 and by a pair of hooks 26 that are secured to the side wall portions 14 and 15.

Illustrated most clearly in FIG. 5 is a release assembly 27 for discharging the explosion suppressant retained by the container 18 and a tabulation assembly 28 connected for fluid communication with the pressure detector 19. The release assembly 27 includes a discharge tube 31 extending between the container 18 and a discharge port 32. Retained within the discharge tube 31 is a sealed diaphragm (not shown) that can be ruptured by detonation of an explosive squib unit 33 to induce discharge of the explosion suppressant through the discharge tube 31 and the discharge port 32. The rupturable disc and squib 33 are conventional and of the types, for example, disclosed in U.S. Pat. Nos. 2,712,881 and 3,523,583. Included in the tubulation assembly 28 is an inclined transparent tube portion 35 that terminates at an inlet port 36 and an extended portion 39 that terminates at a threaded access port 37. The opposite end of the inclined tube portion 35 communicates with a vertical tube portion 38 that joins the inlet chamber of the pressure detector 19. As shown, the inclined tube portion 35 includes a substantial vertical component V and a substantial horizontal component H. Closing the access port 37 is a threaded cover 41 that accommodates reciprocating movement of an operator rod 42 that is biased outwardly by a spring member 43 and has an outer end attached to an operator handle 44. Secured to the opposite end of the operator rod 42 and reciprocatively disposed within the inclined tube portion 35 is a coil member plunger 45.

Figure 6:
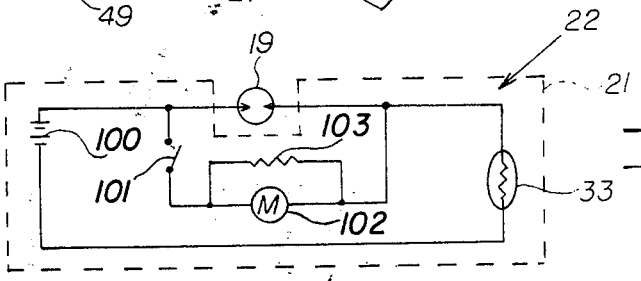
FIG. 6 is a schematic circuit diagram of a control circuit of the apparatus shown in FIGS. 1–5.

Referring now to FIG. 6, there is schematically illustrated a diagram of the control circuit 22 retained by the housing 21 shown in FIG. 1. A battery 100 is connected to the electrically actuated explosive squib 33 by the pressure switch 19. Connected across the pressure switch 19 is a manually operated test switch 101 and a parallel combination of a DC voltmeter 102 and a resistor 103. The switch 101 and the meter 102 can be used to periodically evaluate circuit continuity and voltage level of the battery 100. A resistive load for such tests is provided by the resistor 103 which also functions to limit test current to a level insufficient to fire the explosion squib 33.

OPERATION OF THE PREFERRED EMBODIMENT

As shown in FIG. 5, the unit 11 is typically installed in close proximity to an external wall surface 46 of a structure that encloses a zone 47 to be protected from explosion. The structure 46 could comprise, for example, a grain elevator, a milling plant, etc. After appropriate mounting of the unit 11, both the inlet port 36 of the tubulation 28 and the discharge port 32 of the release assembly 27 register with and are in fluid communication with an opening 48 in the structure 46 that defines the protected zone 47. A rectangularly shaped sealing gasket 49 is positioned between the structure wall 46 and the rear wall portion 13 of the device 11 so as to encircle the communication opening 48, the discharge port 32 and the inlet port 36 thereby providing a fluid-tight seal thereabout.

Prior to installation, a removable plug 57, shown in FIGS. 2–4, is removed from the discharge port 32 of the unit 11. The plug 57 is employed as a protective feature during shipping and handling of the unit 11. In the event of an inadvertent rupture of the frangible diaphragm (not shown) in the discharge tube 31, the pressurized suppressant within the container 18 is released from diammetrically positioned side openings 58 in the plug 57 thereby producing equal and opposite reaction forces that prevent a potentially dangerous propulsion of the unit 11 that could be produced by a unidirectional suppressant discharge. Fixed to the outer surface of the plug 57 is an obstruction rod 59. As shown in FIG. 4, the rod 59 has a dimensional length greater than the maximum dimensional opening provided by the annular seal 49 and therefore greater than the maximum dimensional opening of the communication opening 48 in the structure 46. Consequently, the unit 11 cannot be installed inadvertently into the operative position shown in FIG. 5 without prior removal of the plug 57.

Once installed, the unit 11 continuously monitors the pressure conditions existing within the protected zone 47 (FIG. 5). In response to an incipient explosion within the zone 47, a resultant pressure wave is transmitted through the communication opening 48, the inlet port 36, the inclined tube portion 35 and the vertical tube portion 38 to the pressure switch 19. Closure of the pressure switch 19 produces current flow between the battery 100 and the explosive squib 33 (FIG. 6) causing detonation thereof and discharge of the suppressant within the container 18. The discharged suppressant is transmitted through the discharge tube 31, the discharge port 32 and the communication opening 48 into the protected zone 47 to suppress the detected explosion.

The inclined tube portion 35 permits mounting of the pressure detector 19 in a position that is both external to the protected zone 47 and displaced upwardly from the communication opening 48. The first factor facilitates mounting of the unit 11 in a position that will not disrupt activities within the protected zone 47 and where the unit is readily accessible for servicing and monitoring by appropriate personnel. The second factor greatly reduces the amount of dust that can migrate from the protected zone 47 and accumulate in the tubulation 28. This reduces substantially the possibility of a blockage in the tubulation 28 that would prevent the passage to the detector 19 of a pressure wave generated by an incipient explosion. To further reduce such a possibility, the inclined tube portion 35 is formed of a transparent material so as to render blockages visible to service personnel. Any dust debris that does accumulate within the inclined tube portion 35 is easily removed by repeatedly forcing the operator handle knob 44 inwardly against the biased spring 43. That action produces reciprocating movement of the coil plunger 45 within the inclined tube portion 35 and results in discharge of any accumulated dust debris through the inlet port 36. During such a clean-out operation, the coiled shape of the plunger 45 inherently prevents the generation of pressure waves that might actuate the pressure detector 19.

Figure 7:
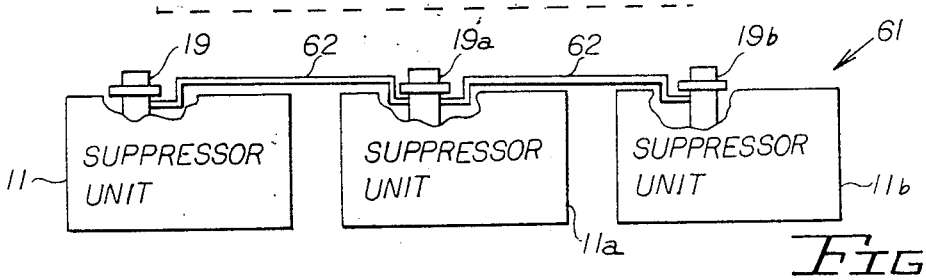
FIG. 7 is a schematic diagram illustrating a system composed of a plurality of the explosion suppression units shown in FIGS. 1–5.

Illustrated in FIG. 7 is an explosion suppression system 61 in which the unit 11 is interconnected with identical units 11*a* and 11*b*. The units 11, 11*a* and 11*b* are mounted at spaced apart locations externally of a structure defining a protected zone as shown in FIG. 5. Interconnecting the pressure inlets of the pressure detectors 19, 19*a* and 19*b* is a pneumatic tubulation 62. In the event that an activating pressure wave is received by any of the detectors 19, 19*a* or 19*b*, the pneumatic tubulation 62 insures that activating pressure will be received also by all other detectors of the system 61. Thus, all suppressor units of the system 61 are sympathetically activated to discharge their suppressant in response to the detection of a pressure wave by any individual detector even though the pressure inlet tubulation 28 of any particular unit has become clogged by dust.

Figure 8:
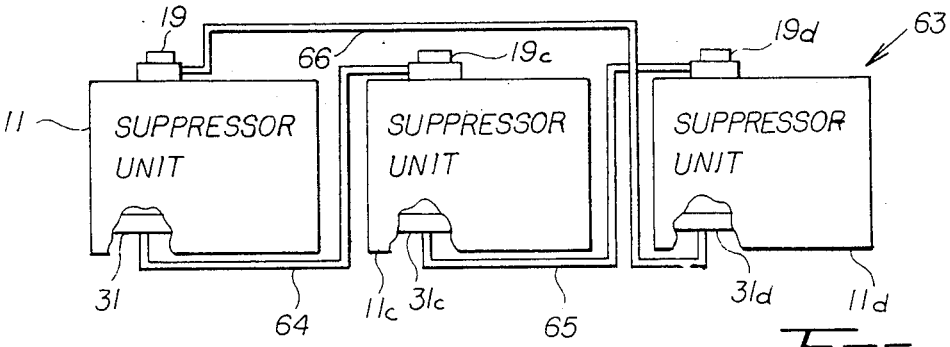
FIG. 8 is a schematic diagram illustrating another system composed of a plurality of the suppression units shown in FIGS. 1–5.

FIG. 8 schematically illustrates another system 63 which insures sympathetic operation of all suppression units even though certain pressure inlets may be clogged. Again, the system 63 consists of a plurality of suppressor units 11, 11*c* and 11*d*. A pneumatic tube 64 joins the discharge tube 31 of the unit 11 to the pressure inlet of the pressure detector 19*c*. Similarly, a pneumatic tube 65 connects the discharge tube 31*c* of the unit 11*c* with the pressure inlet of the detector 19*d*. Finally, the discharge tube 31*d* of the unit 11*d* is connected by a pneumatic tube 65 to the pressure inlet of the detector 19. A discharge from any of the units 11, 11*c* or 11*d* produces in its discharge tube a high pressure that is transmitted by one of the pneumatic tubes 64–66 to an adjacent detector to cause discharge by its units. That discharge in turn results in the transmission of an activating pressure wave to a succeeding unit until all units have been activated. Thus, the system 63 insures discharge from all units in the event that any individual unit is activated.

Obviously, many modifications and variations of the present invention are possible in light of the above teachings. It is to be understood, therefore, that the invention can be practiced otherwise than as specifically described.

What is claimed is:

1. Explosion suppression apparatus comprising:

structural means enclosing a protected zone;

a source of a pressurized explosion suppressant;

pressure detector means for detecting pressure waves;

release means for releasing said suppressant into the protected zone in response to detection of a pressure wave by said detector means, said release means comprising a discharge port opening into the protected zone;

tubulation means including an inclined portion providing fluid communication between said detector means and the protected zone, said inclined portion comprising both vertical and horizontal components of substantial magnitude and defining an inlet port opening into the protected zone, and wherein said source, said release means and said tubulation means are disposed externally of said structural means and disposed horizontally with respect to said protected zone; and portable unitary frame means supporting said source, said tubulation means, and said release means.

2. An apparatus according to claim 1 wherein said detector means is elevated with respect to said inlet port.

3. An apparatus according to claim 2 wherein said tubulation means further defines an access port disposed externally of the protected zone, and including a removable cover for said access port.

4. An apparatus according to claim 3 including clean-out means operable to remove debris from said inclined portion.

5. An apparatus according to claim 4 wherein said clean-out means comprises a plunger means movable in said inclined portion to force debris out of said inlet port, and an operator means disposed externally of said tubulation means and operable to produce said movement of said plunger means.

6. An apparatus according to claim 5 wherein said operator means is coupled to said plunger means and extends through said cover.

7. An apparatus according to claim 5 wherein said plunger means comprises a coil member reciprocably mounted in said inclined portion.

8. An apparatus according to claim 2 including clean-out means operable to remove debris from said inclined portion.

9. An apparatus according to claim 2 wherein said inclined portion comprises a transparent portion providing visible access thereto.

10. Explosion suppression apparatus for mounting adjacent to a structural wall means enclosing a protected zone and defining a fluid communication opening and comprising:

condition responsive detector means for detecting the initial stage of an explosion in said protected zone;

container means containing a pressurized explosion suppressant;

release means for releasing said suppressant from said container means in response to detection of an explosion by said detector means, said release means defining a discharge port for said suppressant;

frame means supporting said container and release means adjacent to said wall means externally of said protected zone, said frame means disposed so as to provide registration between said discharge port and said communication opening; and removable plug means closing said discharge port and comprising obstruction means projecting axially therefrom, said obstruction means having radial projections that prevent entry of said obstruction means into said communication opening such that mounting of said suppression apparatus closely adjacent to said wall means so as to provide a fluid-tight seal around said discharge port and said communication opening requires removal of said plug means from said discharge port.

11. An apparatus according to claim 10 including annular seal means for engagement between said wall means and said frame means, and for encircling both said communication opening and said discharge port and providing a fluid-tight seal thereabout after said removal of said plug means.

12. An apparatus according to claim 11 wherein said detector means is a pressure detector supported by said frame means, and including a tubulation means providing fluid communication between said protected zone and said pressure detector.

13. An apparatus according to claim 12 wherein said tubulation means defines an inlet port communicating with said communication opening and encircled by said annular seal means.

14. An apparatus according to claim 13 wherein said detector means is horizontally displaced with respect to said protected zone, and said tubulation means comprises an inclined portion having both vertical and horizontal components of substantial magnitude.

15. Explosion suppression apparatus comprising:

structural means enclosing a protected zone;

a source of a pressurized explosion suppressant;

pressure detector means for detecting pressure waves;

release means for releasing said suppressant into the protected zone in response to detection of a pressure wave by said detector means, said release means comprising a discharge port opening into the protected zone;

tubulation means including an inclined portion providing fluid communication between said detector means and the protected zone, said inclined portion comprising both vertical and horizontal components of substantial magnitude and defining an inlet port opening into the protected zone, and wherein said source, said release means and said tubulation means are disposed externally of said structural means and disposed horizontally with respect to said protected zone; and a frame means supporting said source of explosion suppressant and release means adjacent to said structural means externally of said protected zone, said frame means disposed so as to provide registration between said discharge port and said inlet port opening; and annular seal means engaged between said structural means and said frame means, said seal means encircling both said discharge port and said inlet port and providing a fluid-tight seal thereabout.

16. An apparatus according to claim 12 wherein said release means is electrically operated, and including an electrical control circuit supported by said frame means and connected between said detector means and said release means.

17. An apparatus according to claim 16 wherein said control circuit comprises battery means for supplying operating energy to said release means in response to detection of an explosion by said detector means.

18. An apparatus according to claim 15 wherein said release means is electrically operated, and including an electrical control circuit supported by said frame means and connected between said detector means and said release means.

19. An apparatus according to claim 18 wherein said control circuit comprises battery means for supplying operating energy to said release means in response to detection of an explosion by said detector means.

20. An explosion protection system comprising:

a plurality of suppressor units each retaining a supply of explosion suppressant, said units being distributed about a protected zone;

a plurality of pressure detector means for detecting pressure waves, one associated with each of said units, each of said detector means comprising an inlet for receiving said pressure waves;

a plurality of release means, one for releasing said suppressant into the protected zone from each of said units in response to detection of a pressure wave by said detector means associated therewith each of said release means comprising an outlet for discharging said suppressant;

pneumatic tubulation means interconnected between said inlets and said outlets and adapted in response to detection of a pressure wave by any of said detector means to produce pressure waves for detection by all of said other detector means, said tubulation means comprising tubing interconnecting said detector inlets and said release means outlets.

* * * * *